United States Patent [19]

Wakai

[11] Patent Number: 4,640,316

[45] Date of Patent: Feb. 3, 1987

[54] FLOW VELOCITY DISTRIBUTION DETECTING SYSTEM

[75] Inventor: Shinzi Wakai, Tokyo, Japan

[73] Assignee: Nissan Motor Co., Ltd., Yokohama, Japan

[21] Appl. No.: 816,743

[22] Filed: Jan. 6, 1986

[30] Foreign Application Priority Data

Jan. 17, 1985 [JP] Japan ..... 60-4848
Jan. 21, 1985 [JP] Japan ..... 60-7422
Jan. 29, 1985 [JP] Japan ..... 60-13472

[51] Int. Cl.[4] ..... D03J 1/00

[52] U.S. Cl. ..... 139/1 R; 139/1 C; 139/370.2; 73/198; 73/866.5; 15/312 R

[58] Field of Search ..... 139/1 R, 1 C, 435, 188 R; 73/198, 423 B, 861.66; 15/312 R, 246

[56] References Cited

U.S. PATENT DOCUMENTS 4,465,110 8/1984 Dekker ..... 139/370.2
4,468,620 8/1984 Vaerman ..... 73/432 B
4,471,816 9/1984 Wada ..... 139/370.2
4,503,889 3/1985 Mullekom ..... 139/1 R
4,516,425 5/1985 Chollet et al. ..... 73/198
4,527,596 7/1985 Kagi ..... 15/312 X
4,573,856 3/1986 Meyer et al. ..... 139/1 R

*Primary Examiner*—Henry S. Jaudon
*Attorney, Agent, or Firm*—Schwartz, Jeffery, Schwaab, Mack, Blumenthal & Evans

[57] ABSTRACT

A system for detecting the distribution of flow velocity is used in combination with an air jet loom of the type wherein auxiliary nozzles eject air into an air guide channel formed on the front side of a reed. The system consists of a carrier engageable with a rail disposed parallel with the reed and movable along the rail. The carrier carries a flow velocity detector whose flow velocity sensing section is located in the air guide channel, thereby effectively detecting the distribution of flow velocity of air stream throughout whole the air guide channel.

29 Claims, 19 Drawing Figures

FLOW VELOCITY DISTRIBUTION DETECTING SYSTEM

BACKGROUND OF THE INVENTION

1. Field of the Invention

This invention relates to a system for detecting the distribution of flow velocity of an air stream for accomplishing weft picking and an application thereof, used in combination with an air jet loom of the type wherein auxiliary nozzles eject air to form the air stream flowing through an air guide channel formed on the front side of a reed.

2. Description of the Prior Art

As is well known in the art, an air jet loom of the above-mentioned type operates as follows: A weft yarn is projected from a weft inserting or main nozzle, through the air guide channel while the auxiliary nozzles aligned along the air guide channel eject air into the air guide channel to form the air stream guided through the air guide channel toward an anti-weft picking side, so that the weft yarn is successively carried toward the anti-weft picking side to complete a weft picking.

The loom of this type is suitable for weaving a wide cloth but requires a larger amount of air per a unit length of weft picking, and therefore is disadvantageous from an air economical view point.

In this regard, in designing an improved air jet loom, the propagation state of ejected air streams from the auxiliary nozzle has been experimentally grasped by using a current meter such as one of the pitot tube type in order to achieve air economy by improving the air guide function of the air guide channel. However, since a plurality of the ejected air streams from a plurality of the auxiliary nozzles affect each other within the air gudie channel, it is very difficult to linearly analyze the distribution state of the air streams in the whole air guide channel.

Additionally, in a weaving factory, adjustments are made on installation location and air ejection direction of the auxiliary nozzles, air pressure to be supplied to the auxiliary nozzles and the like to obtain an appropriate flow velocity throughout the whole air guide channel thereby to find out a functional and economical appropriate air ejection condition in accordance with weaving conditions. However, such adjustments are considerably difficult and troublesome and in practice must depend on the perception of a skilled operator.

SUMMARY OF THE INVENTION

A system of the present invention is used in combination with an air jet loom of the type wherein auxiliary nozzles eject air into an air guide channel formed on the front side of a reed to accomplish weft picking. The device consists of a rail disposed parallel with the reed and extending in the direction of weft picking. A carrier is provided to be engageable with the rail and movable along the rail. The carrier is maintained in a predetermined posture. Additionally, a flow velocity detector is provided to detect the flow velocity of air flowing through the air guide channel. The flow velocity detector is carried by the carrier and has a flow velocity sensing element located in the air guide channel.

With this system, since the carrier can move along the weft picking direction carrying the flow velocity detector and being maintained in the predetermined posture, the flow velocity sensing element is located in a predetermined position in the cross-section of the air guide channel and can move along the weft picking direction. Accordingly, the state of air stream in the predetermined position can be continuously grasped throughout the whole air guide channel. The analized result of the thus obtained data can be provided as effective materials for designing an improved air jet loom. Additionally, air ejection condition and the like can be suitably and easily set depending upon the thus obtained data in a weaving factory.

BRIEF DESCRIPTION OF THE DRAWINGS

The features and advantages of the system according to the present invention will be more clearly appreciated from the following description taken in conjunction with the accompanying drawings in which same reference numerals designate same elements and parts, and in which.

DETAILED DESCRIPTION OF THE INVENTION

Figure 1:
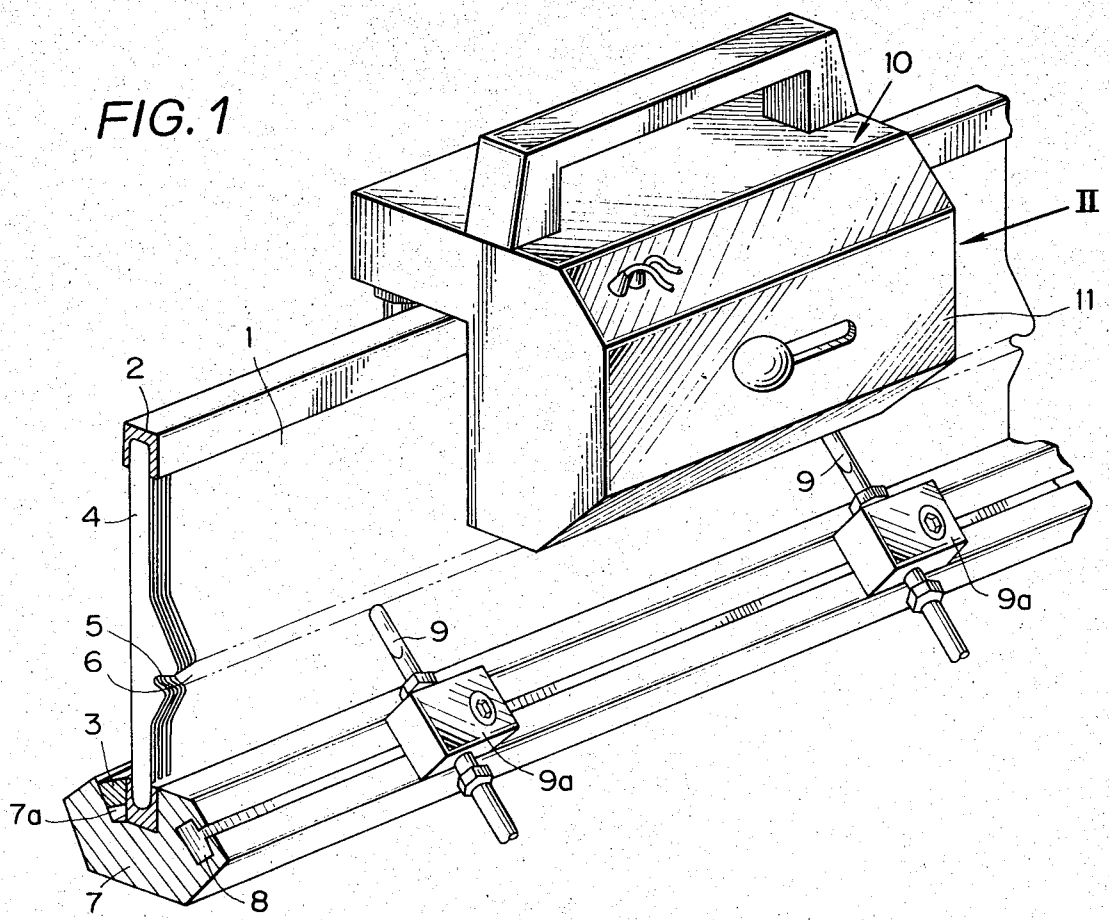
FIG. 1 is a perspective view of a first embodiment of a system according to the present invention used in combination with an air jet loom whose essential part is shown.

Referring now to FIGS. 1 to 6, there is shown a first embodiment of a system according to the present invention to be used in combination with an air jet loom. The system in this embodiment serves as a flow velocity distribution detecting system. Particularly referring to FIG. 1, an essential part of the loom is shown including a reed 1 having upper and lower frames 2, 3. A plurality of reed blades 4 are securely disposed between the upper and lower frames 2, 3 in such a manner that the upper section of each reed blade 4 is securely fixed to the upper frame 2 while the lower section of the same to the lower frame 3. The reed blades 4 are aligned along the length of the frames 2, 3 and closely located side by side to form a narrow space between the adjacent reed blades 4. Each reed blade 4 of this instance is a so-called deformed reed blade and has a generally triangular section projected forward of a main body of the reed blade 4 in which a groove 5 is formed at tip of the triangular section, so that a row of the grooves 5 of reed blades 4 constitute an air guide channel through which a weft yarn (not shown) projected from a weft inserting nozzle (not shown) is picked into the shed of warp yarns (not shown).

The reed 1 is secured to a reed holder 7 in such a manner that the lower frame 3 of the reed 1 is securely disposed in an elongated groove 7*a* of the reed holder 7. The reed holder 7 is formed with a groove 8 having a T-shaped cross-section and extending in the direction of weft picking or in the advancing direction of the weft yarn projected from the weft inserting nozzle. A plurality of auxiliary nozzles 9 are movably installed to the reed holder 7 and located along the weft picking direction. More specifically, each auxiliary nozzle 9 is securely supported by a support body 9*a* which is formed with a section having a T-shaped cross-section which section is slidably disposed in the groove 8. Each auxiliary nozzle has an air ejection opening (not shown) from which an air jet is ejected and which opening is located in the vicinity of the lower periphery of the air guide channel 6. Accordingly, the air jet from the auxiliary nozzle 9 is ejected into the air guide channel diagonally toward a so-called anti-weft picking side on which the flight travel of the tip end of the weft yarn projected from the weft inserting nozzle terminates.

A flow velocity distribution detecting device 10 forming part of the system is provided to detect the distribution of the flow velocity of air flowing through the air guide channel 6. The detecting device 10 is covered with a cover and slidably movably mounted on the upper reed frame 2 extending in the weft picking direction or parallel with the air guide channel 6. In this instance, the upper reed frame 2 serves as a rail on which the detecting device 10 is slidably movably mounted, so that the upper reed frame 2 is referred to as the "rail" hereinafter. Otherwise, the reed holder 7 may be provided with an elongated member serving as the rail which member extending in the weft picking direction.

Figure 2:
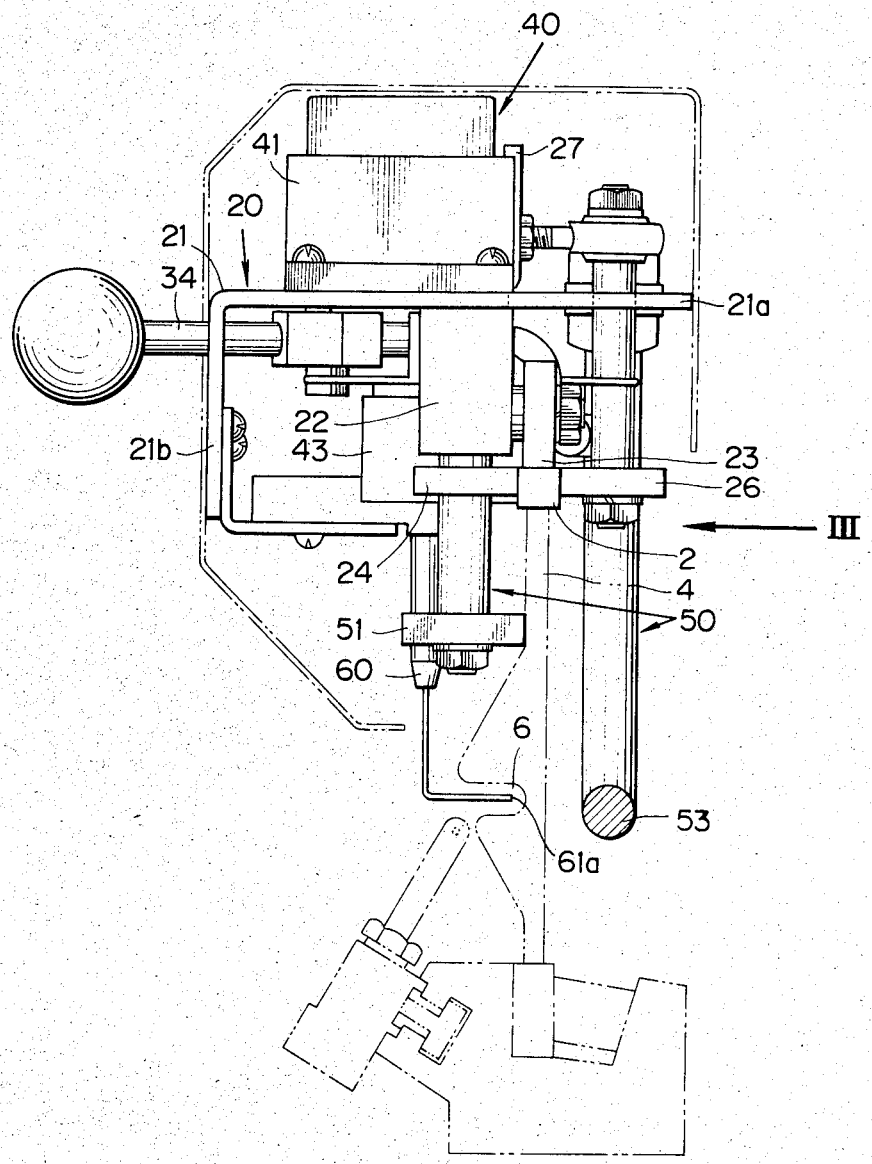
FIG. 2 is a side view, partly in section, of the system of FIG. 1 as viewed from the direction of an arrow II of FIG. 1.
Figure 3:
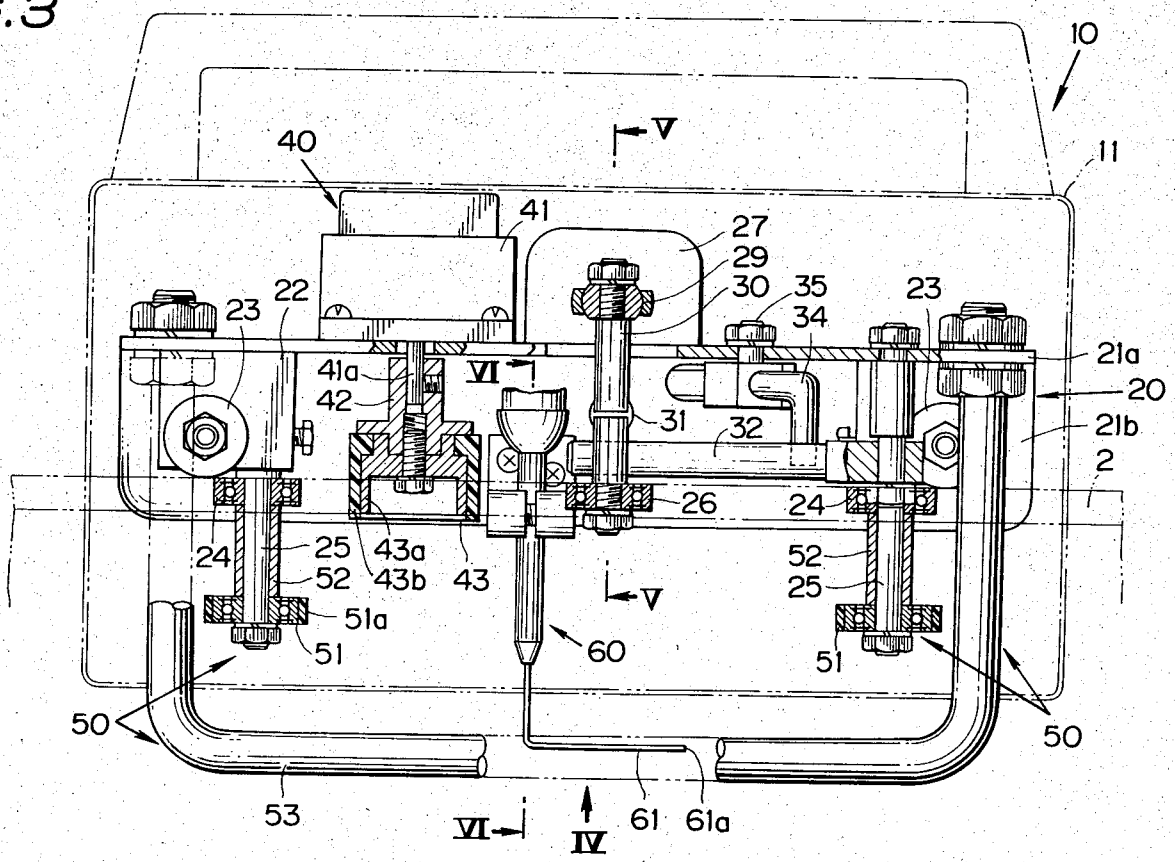
FIG. 3 is an elevational view, partly in section, as viewed from the direction of an arrow III of FIG. 2.
Figure 4:
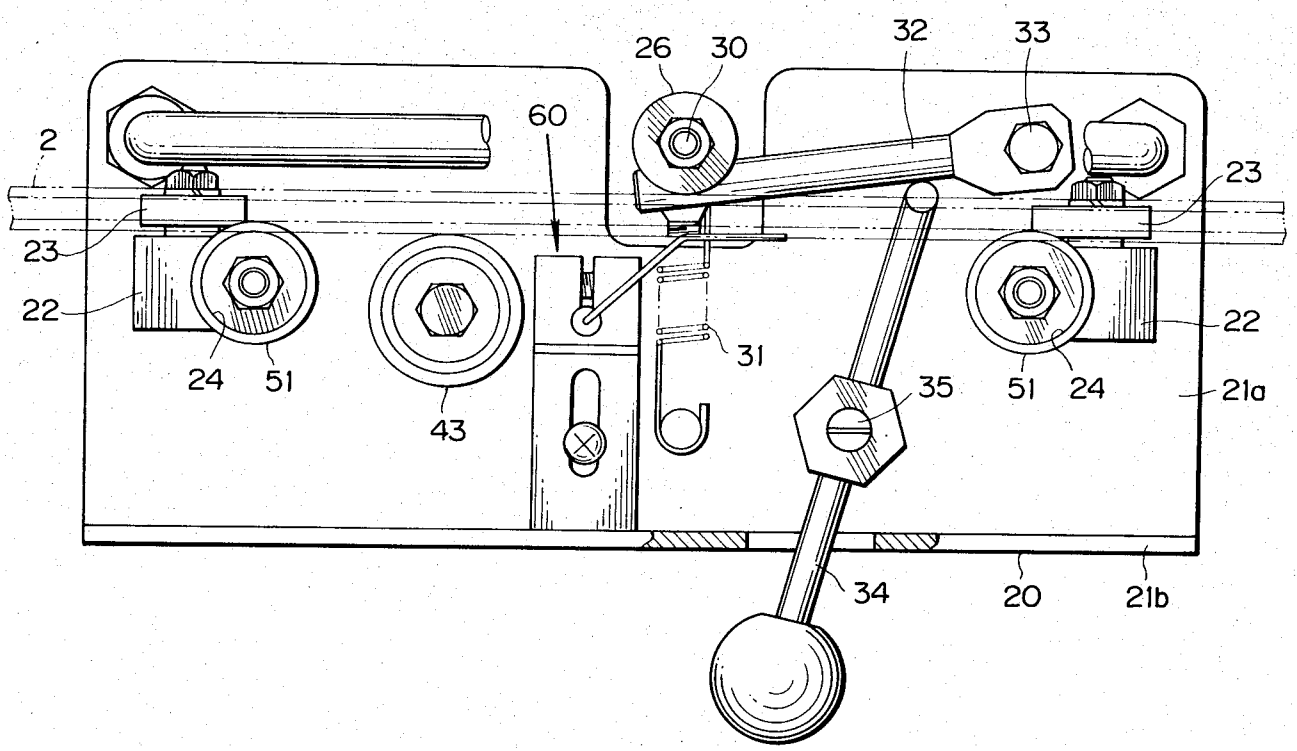
FIG. 4 is a bottom view, partly in section, as viewed from the direction of an arrow IV of FIG. 3.

As shown in FIGS. 2, 3 and 4, the flow velocity distribution detecting device 10 includes a carrier 20 which has a base plate 21. The base plate 21 consists of a upper plate section 21*a*. A side plate section 21*b* is integral with the upper plate section 21*a* and extending downward perpendicularly from the upper plate section 21*a*. A pair of brackets 22, 22 are securely installed to the upper plate section 21*a* on the lower surface. Two running rollers 23, 23 are rotatably supported by the brackets 22, 22, respectively, in such a manner that each running roller 23 is located on the rear side of each bracket 22. Each running roller 23 is engaged with the upper surface of the rail 2. The brackets 22, 22 are provided with shafts 25, 25 (as shown in FIG. 3), respectively. Two side rollers 24, 24 are rotatably mounted on the shafts 25, 25 at the upper end sections, respectively, and engaged with the front side face of the rail 2. A press roller 26 is located intermediate between the side rollers 24. 24 and elastically engaged with the rear side surface of the rail 2. The supporting structure of the press roller 26 will be explained hereinafter.

Figure 5:
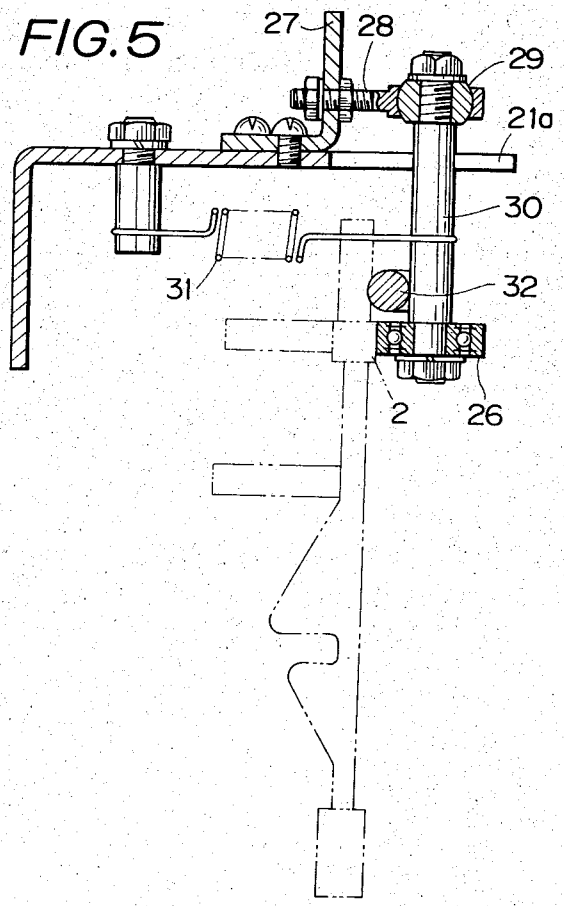
FIG. 5 is a cross-sectional view taken in the direction of arrows substantially along the line of V—V of FIG. 3.

As mainly shown in FIGS. 3 and 5, a bracket 27 is disposed on the upper plate section 21*a* of the base plate 21 and extends upward. An arm 28 is projected from the bracket 27 and provided at its tip end section with a ball joint 29. A swingable shaft 30 swingably hangs down from the arm 28 through the ball joint 29. The press roller 26 is rotatably mounted on the swingable shaft 30 at the lower end section. Additionally, the swingable arm 30 is biased forward by means of a tension spring 31, so that the press roller 26 is brought into press contact with the rail 2. A bar 32 is provided to release the engagement of the press roller 26 with the rail 2. As shown in FIG. 4, the bar 32 is pivotally connected at its base end section to a stud 33 planted on the upper plate section 21*a* of the base plate 21 and contactable at its free end section with the swingable arm 30 at the front side face. An operation lever 34 as shown in FIG. 4 is pivotally connected at its middle section to the upper plate section 21*a* by means of a stud 35 projected downward from the upper plate section 21*a*. The rear end section of the operation lever 34 is bent as shown in FIG. 3 and brought into contact with the front side face of the bar 32. Accordingly, when the operation lever 34 is operated to rotate counterclockwise in FIG. 4, the swingable shaft 30 swings rearward thereby causing the press roller 26 to separate from the rail 2.

As mainly shown in FIG. 3, a driving means 40 is provided to cause the carrier 20 to move or run along the rail 2. The driving means 40 includes an electrically operated geared motor 41 which is reversible in rotation and fixed on the upper plate section 21*a* of the base plate 21 of the carrier 20. The geared motor 41 has an output shaft 41*a* on which a coupling 42 is fixedly mounted. A drive roller 43 is fastened on the coupling 42 and has a hub 43*a* on which a tire 43*b* made of rubber or the like is installed. This drive roller 43 is elastically engaged with the rail 2 on the front side face under a suitable press contact force.

It will be understood from the above, that the center of gravity of the carrier 20 with the driving means 40 lies in front of the running wheels 23, 23 so that the carrier 20 will incline to fall forward. In view of this, a posture maintaining means 50 is provided to maintain carrier 20 engaged with the rail 2 in a predetermined posture. The posture maintaining means 50 includes two support rollers 51, 51 each of which is provided at its peripheral section with a tire 51*a* made of an elastic material such as rubber. The support rollers 51, 51 are rotatably mounted on the shafts 25, 25, respectively, at the lower ends, in which a sleeve 52 is interposed between the support roller 51 and the side roller 24. The support rollers 51, 51 are engaged at their tire 51*a* with the front side of the row of the reed blades 4 thereby preventing the carrier 20 from falling forward as shown in FIG. 2. Additionally, a weight 53 serving also as a handle is installed to the upper plate section 21*a* and located behind the running wheels 23, 23. This weight 53 functions to adjust the center of gravity of the carrier 20 thereby preventing a larger bending load from being applied to the reed blades 4.

Figure 6:
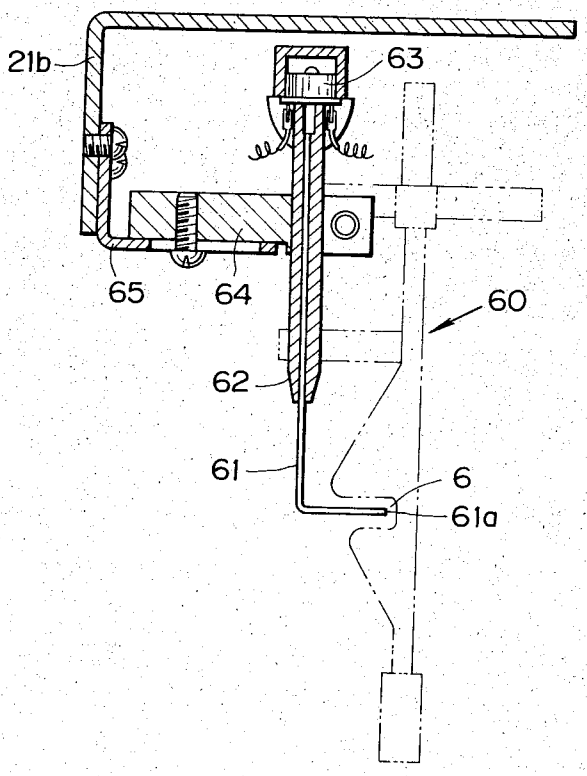
FIG. 6 is a cross-sectional view taken in the direction of arrows substantially along the line of VI—VI of FIG. 3.

Also as shown in FIG. 6, a flow velocity detector 60 is provided to detect the flow velocity of air flowing through the air guide channel 6. The flow velocity detector 60 in this instance is of the pitot tube type and has a pitot tube 61 supported by a holder 62. A flow velocity detecting section 63 is secured to the holder 62 and consists of a flow velocity (pressure)-voltage converting element. The holder 62 is supported by a clamp 64 installed through a L-shaped bracket 65 to the side plate section 21*b* of the base plate 21 of the carrier 20. The tip end section 61*a* of the pitot tube 61 as the flow velocity sensing section or element is inserted into the air guide channel 6 in such a manner that the pitot tube tip end section 61*a* is directed to the upstream side of an air stream flowing in the air guide channel 6 as shown in FIG. 3.

With the thus arranged flow velocity distribution detecting device of FIGS. 1 to 6, when the operation lever 34 is operated to bring the press roller 26 into press contact with the rail 2 upon the running wheels 23, 23 being put on the rail 2, the carrier 20 is brought into engagement with the rail 2 through the wheels 23, 23, the roller 26 and the side rollers 24, 24, maintained in the predetermined engaging posture. At this time, when the geared motor 41 is driven to make the normal rotation or the reverse rotation of the driving roller 43, the carrier 20 runs in the opposite directions along the air guide channel 6, so that the pitot tube tip end section 61*a* of the flow velocity detector 60 moves upon being kept in a predetermined position in the cross-section of the air guide channel 6, thereby sensing continuously the flow velocity of the air stream in the air guide channel 6. The thus sensed flow velocity value is converted to a voltage to be output. Hereinafter, the output voltage is amplified and recorded by a recoder (not shown). It has been experimentally confirmed that the running speed of the carrier 20 is preferably about 80 cm per minute.

Figure 7:
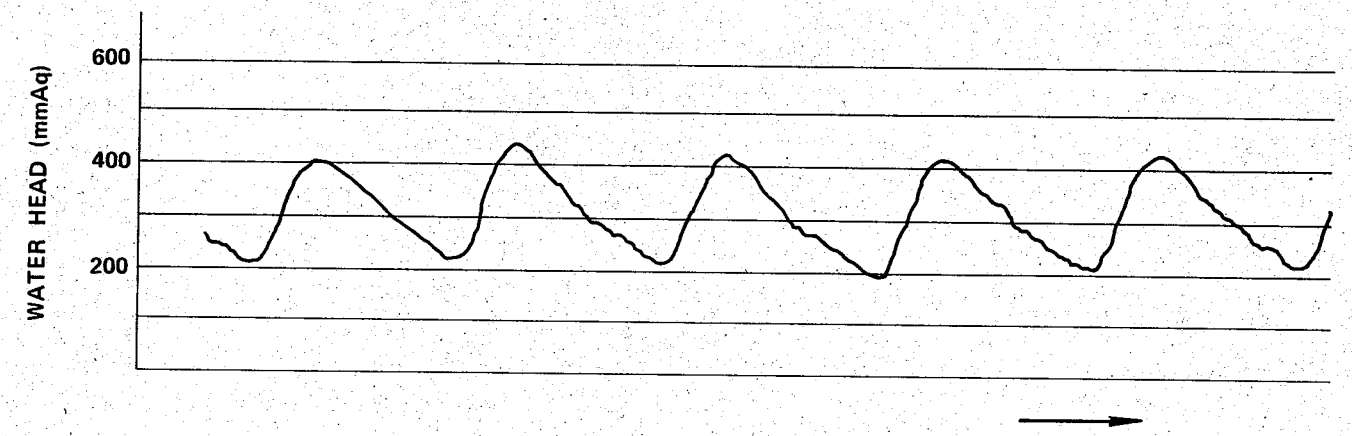
FIG. 7 is a graph showing an example of the data of flow velocity distribution obtained by the system of FIG. 1.

FIG. 7 shows an example of a data recorded by the recorder. In the graph of the data, the ordinate represents flow velocity values converted to water head, while the abscissa represents locations in the weft picking direction in which an arrow indicates the direction of the anti-picking side or the downstream side of the air guide channel 6. The graph was obtained by detecting the flow velocity in the air guide channel 6 upon causing the carrier 20 to run in the direction of the arrow in FIG. 7. It will be understood that the air ejection opening of each auxiliary nozzle 9 was located slightly forward a peak of water head.

Figure 8:
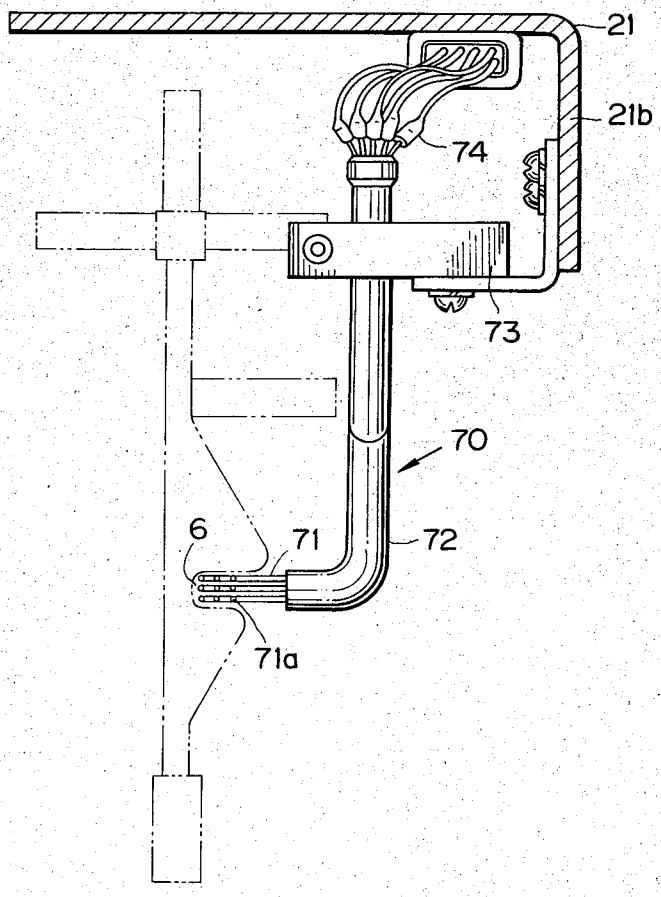
FIG. 8 is a view similar to FIG. 6 but showing a second embodiment of the system according to the present invention.

FIG. 8 illustrates an essential part of a second embodiment of the system according to the present invention which is similar to the system of the first embodiment of FIGS. 1 to 6 with the exception that a plurality of pitot tubes 71 are used in place of only one pitot tube 61. In this embodiment, nine pitot tubes 71 are disposed within a jacket pipe 72 which is securely connected through a bracket (no numeral) to the side plate section 21*b* of the base plate 21 of the carrier 20. In this state, the flow velocity sensing sections or the tip end sections 71*a* of the pitot tubes 71 are located in the air guide channel 6 in such a manner that the open tip ends of the flow velocity sensing sections 71*a* are arranged approximately in a plane corresponding to the cross-section of the air guide channel 6. A flow velocity detecting section 74 serving as a connector is connected to each pitot tube 71 and includes a small-sized flow velicity-voltage convering element. It will be understood that, with this embodiment, the flow velocity distribution in a cross-section of the air guide channel can be effectively obtained.

Figure 11:
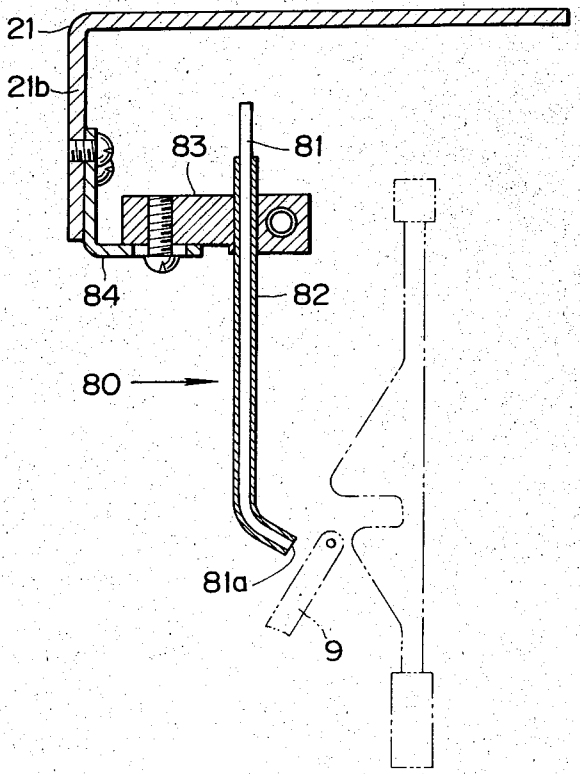
FIG. 11 is a cross-sectional view taken in the direction of arrows substantially along the line of XI—XI of FIG. 10.
Figure 9:
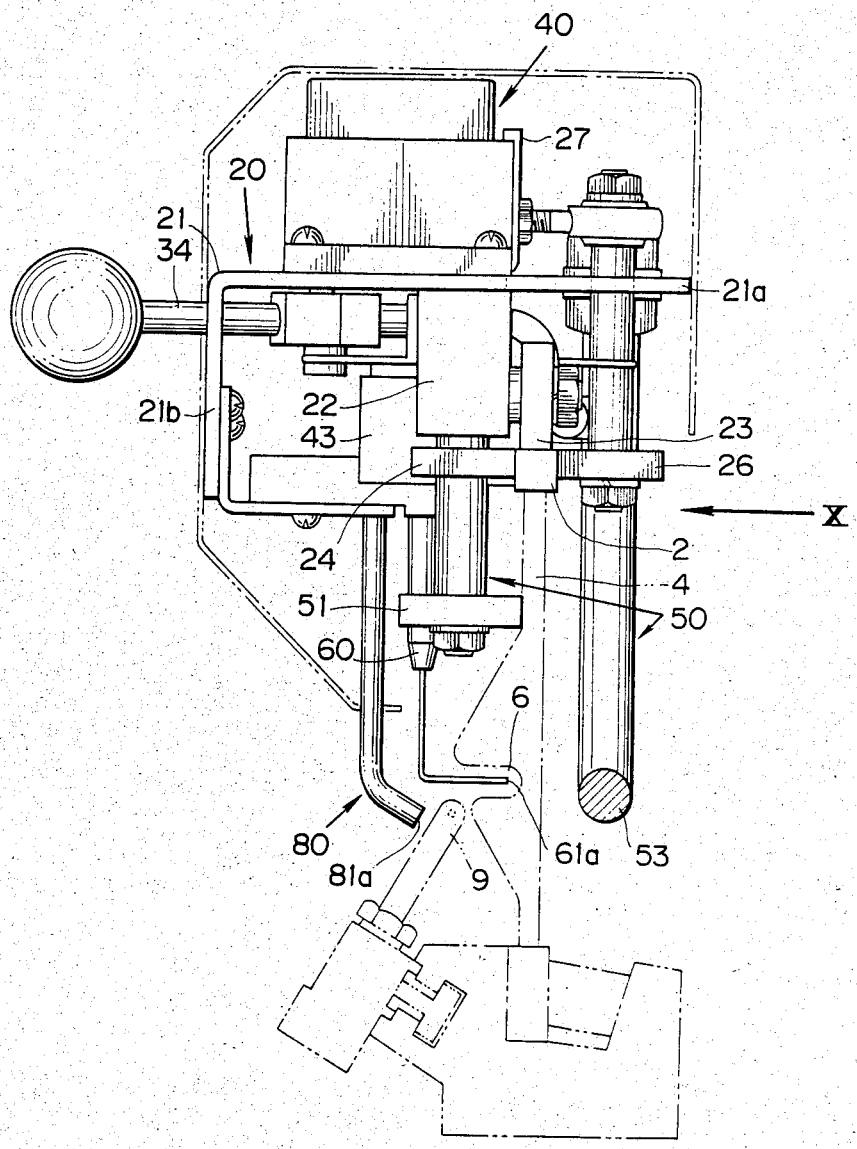
FIG. 9 is a side view similar to FIG. 2 but showing a third embodiment of the system according to the present invention.
Figure 10:
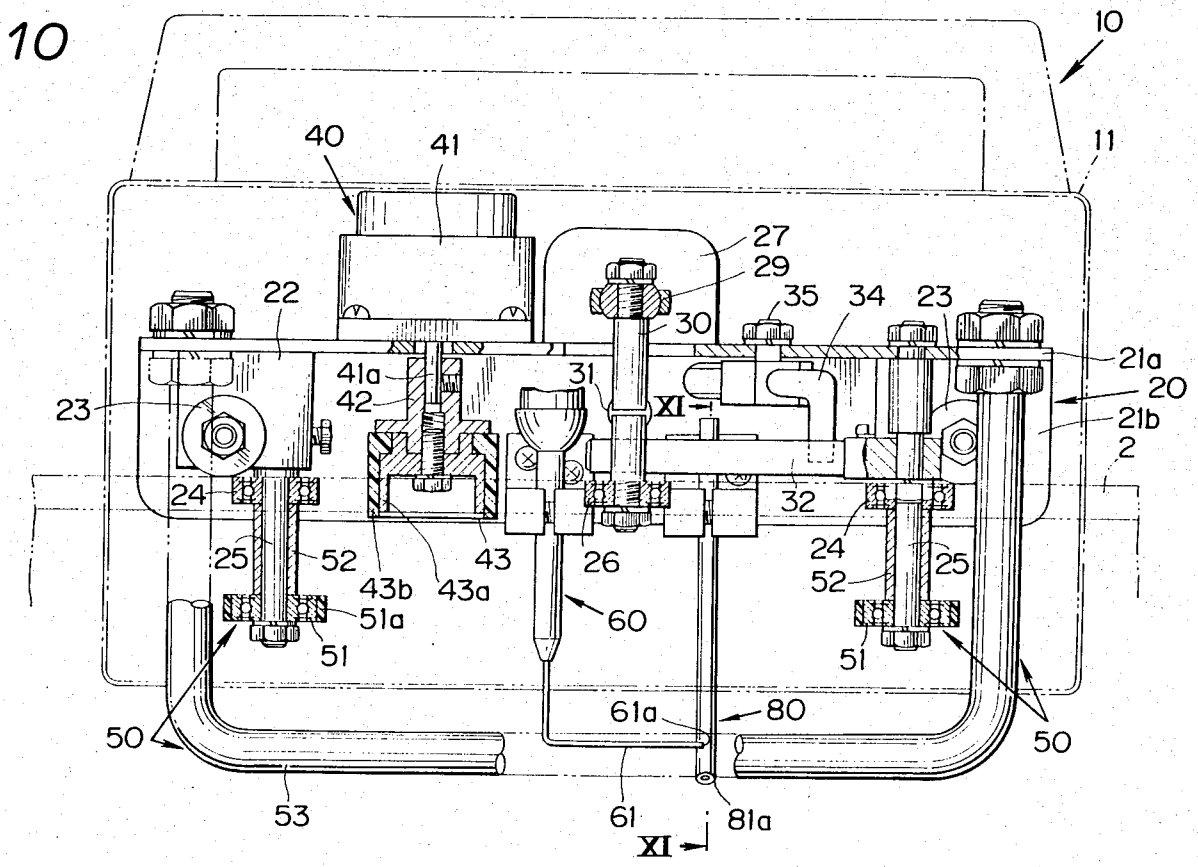
FIG. 10 is an elevational view, partly in section, as viewed from the direction of an arrow of X of FIG. 9.

FIGS. 9 and 11 illustrate a third embodiment of the system according to the present invention which is similar to the first embodiment of FIGS. 1 to 6 except for the existence of a location detector 80 for detecting the location of the auxiliary nozzles 9 along the weft picking direction. The location detector 80 includes a coaxial type optical-fiber cable 81 through which light transmitting and light receiving are made. The optical-fiber cable 81 is housed in a jacket pipe 82 securely received by a clamp 83 which is securely connected through a bracket 84 to the side plate section 21*b* of the base plate 21 of the carrier 20. Thus, the optical-fiber cable 81 is so fixedly connected relative to the carrier 20 that the light casting and receiving section 81*a* at the tip end of the optical-fiber cable 81 can face the auxiliary nozzle 9. Additionally, the optical-fiber cable 81 is so positioned that the tip end or flow velocity sensing section 61*a* of the flow velocity detector 60 meets the optical-fiber cable 81 on a plane parallel with the reel 1 as shown in FIG. 10. Thus, the existence of the auxiliary nozzles 9 can be detected due to a variation in light receiving amount when the flow velocity sensing section 61*a* passes by the auxiliary nozzles 9.

With this arrangement of FIGS. 9 to 11, when the geared motor 41 is driven to move the carrier 20 in a desired direction along the air guide channel 6, the flow velocity detector 61 detects the flow velocity of air stream flowing through the air guide channel 6 so that the flow velocity detecting section 63 converts the flow velocity value sensed by the flow velocity sensing section 61*a* into a voltage corresponding thereto to be output. Simultaneously, the location detector 80 is also moved together with the carrier 20, in which the location detector 80 detects the existence of the auxiliary nozzle 9 depending upon a light receiving amount variation at every time when the light casting and receiving section 81*a* of the optical fiber 81 passes by the auxiliary nozzle 9. Thus, according to this embodiment, the flow velocity distribution in the air guide channel 6 can be detected in connection with the location of the auxiliary nozzles 9.

Figure 12:
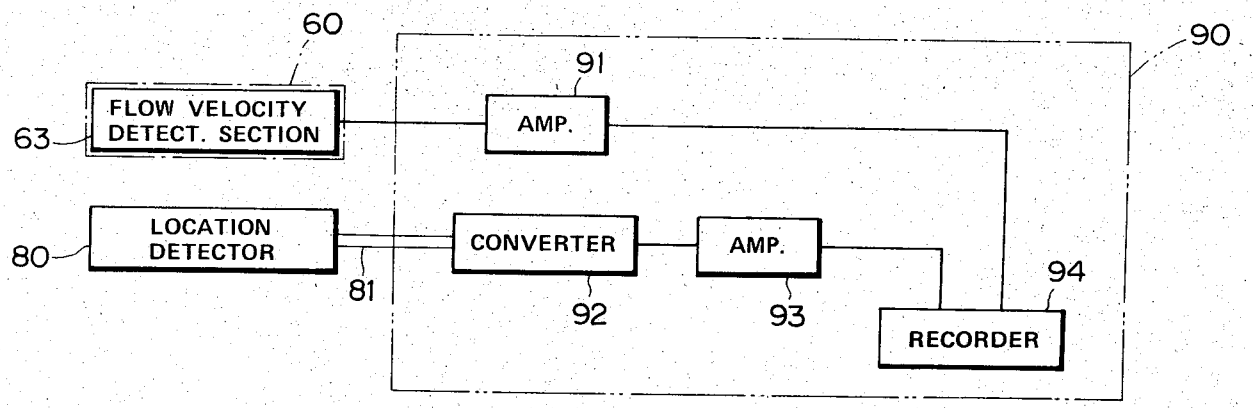
FIG. 12 is a block diagram of a recording device of the data obtained by a flow velocity detecting device of FIG. 9.

FIG. 12 shows an example of a recording device 90 forming part of the system, for recording the output signals from the flow velocity detecting section 63 of the flow velocity detector 60 and from the location detector 80. The recording device 90 includes a first amplifier 91 electrically connected to the flow velocity detecting section 63 and adapted to amplify the signal from the flow velocity detecting section 63. The recording device 90 further includes a converter 91 which is optically connected to the location detector 80 and adapted to convert the light receiving variation in the optical-fiber cable 81 into an electrical variation. The converter 92 is electrically connected to a second amplifier 93 for amplifying the electrical variation. The amplifier 93 is electrically connected to an analogue recorder 94 for recording the output signals from the first and second amplifiers 91, 93.

Figure 13:
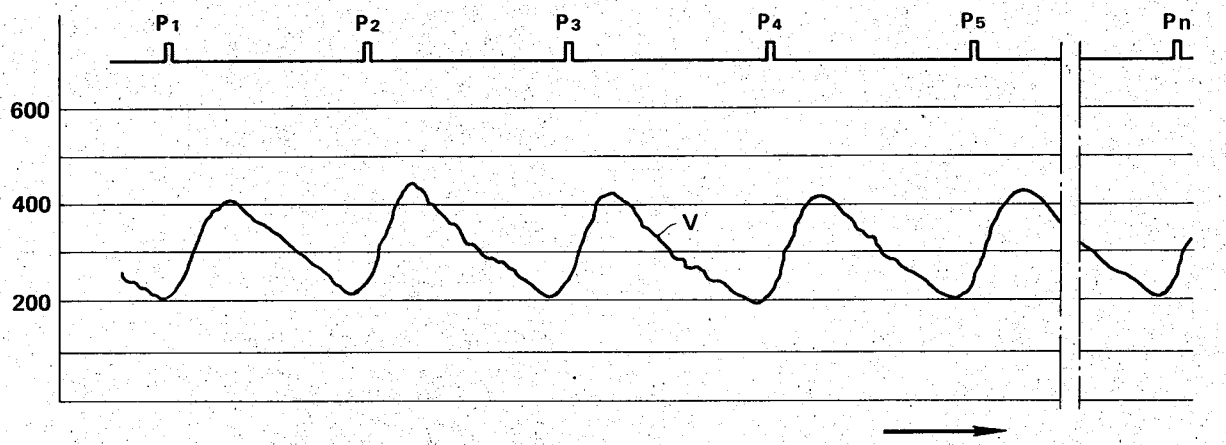
FIG. 13 is a graph of an example of the recorded data obtained by the device of FIG. 12.

FIG. 13 shows an example of a data recorded by the recorder 94 of FIG. 12 in which the graph of the data is similar to that of FIG. 7 except for the locations of the auxiliary nozzles $P_1$ to $P_n$. In the graph of this data, the character V represents the output of an amplifier 91, i.e., a flow velocity curve showing a flow velocity variation in the air guide channel 6. The characters $P_1$ to $P_n$ represent the output of the amplifier 93, i.e., the locations of the auxiliary nozzles 9. The characters $P_1$ to $P_n$ corresponding to the location markings indicating the locations of the flow velocity sensing section 61*a* of the flow velocity detector 60 on a path along which the flow velocity sensing section 61*a* moves with the carrier 20.

It will be appreciated that the flow velocity detector 60 of this embodiment may be replaced with the flow velocity detector 60 shown in FIG. 8 so that the flow velocity distribution in a cross-section of the air guide channel 6 is effectively obtained.

FIGS. 14 to 17 illustrate a fourth embodiment of the system according to the present invention, in which the system serves as a system for detecting a location in a bad condition in the row of the reed blades 4. The system of this embodiment is similar to the third embodiment device of FIGS. 9 to 11 with the exception that air ejection nozzle arrangement 55 and a cleaning means 100 are provided to the system.

Figure 15:
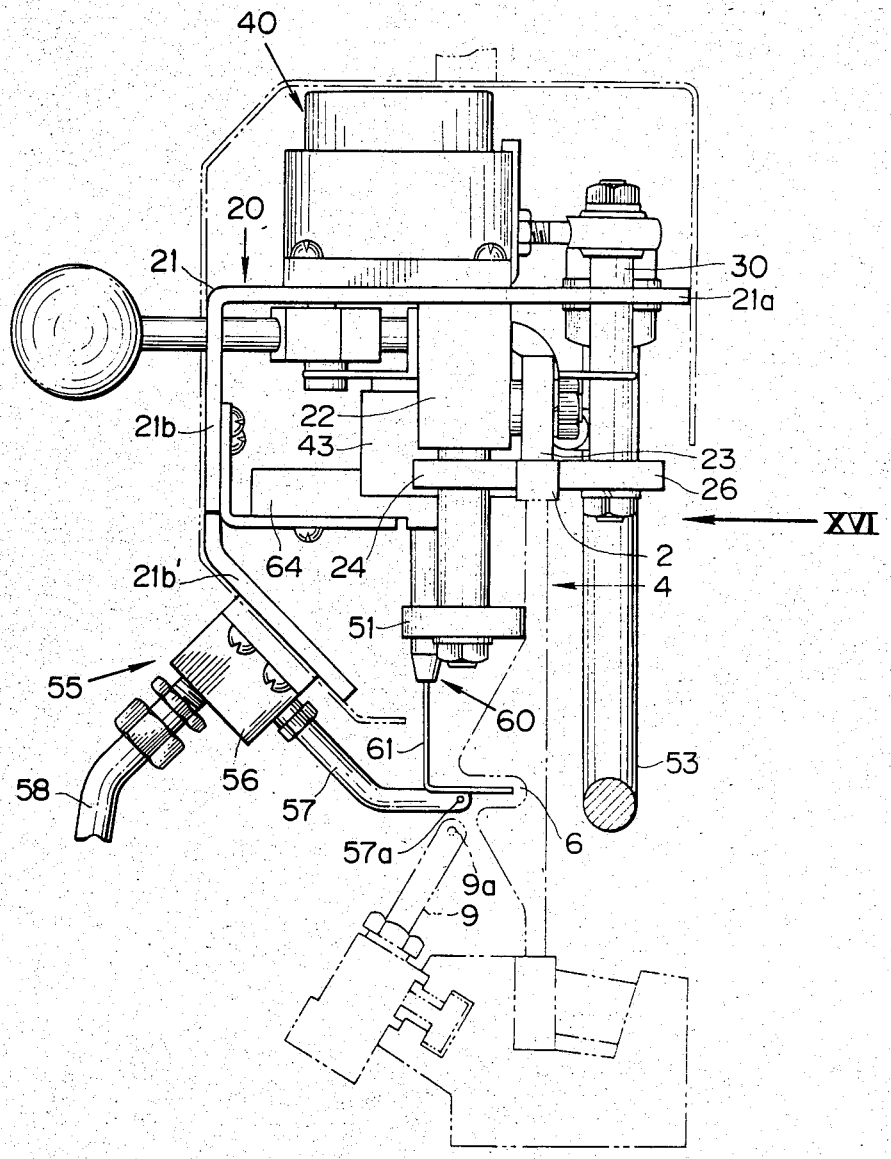
FIG. 15 is a side view, partly in section, of the system of FIG. 14 as viewed from the direction of an arrow XV of FIG. 14.
Figure 16:
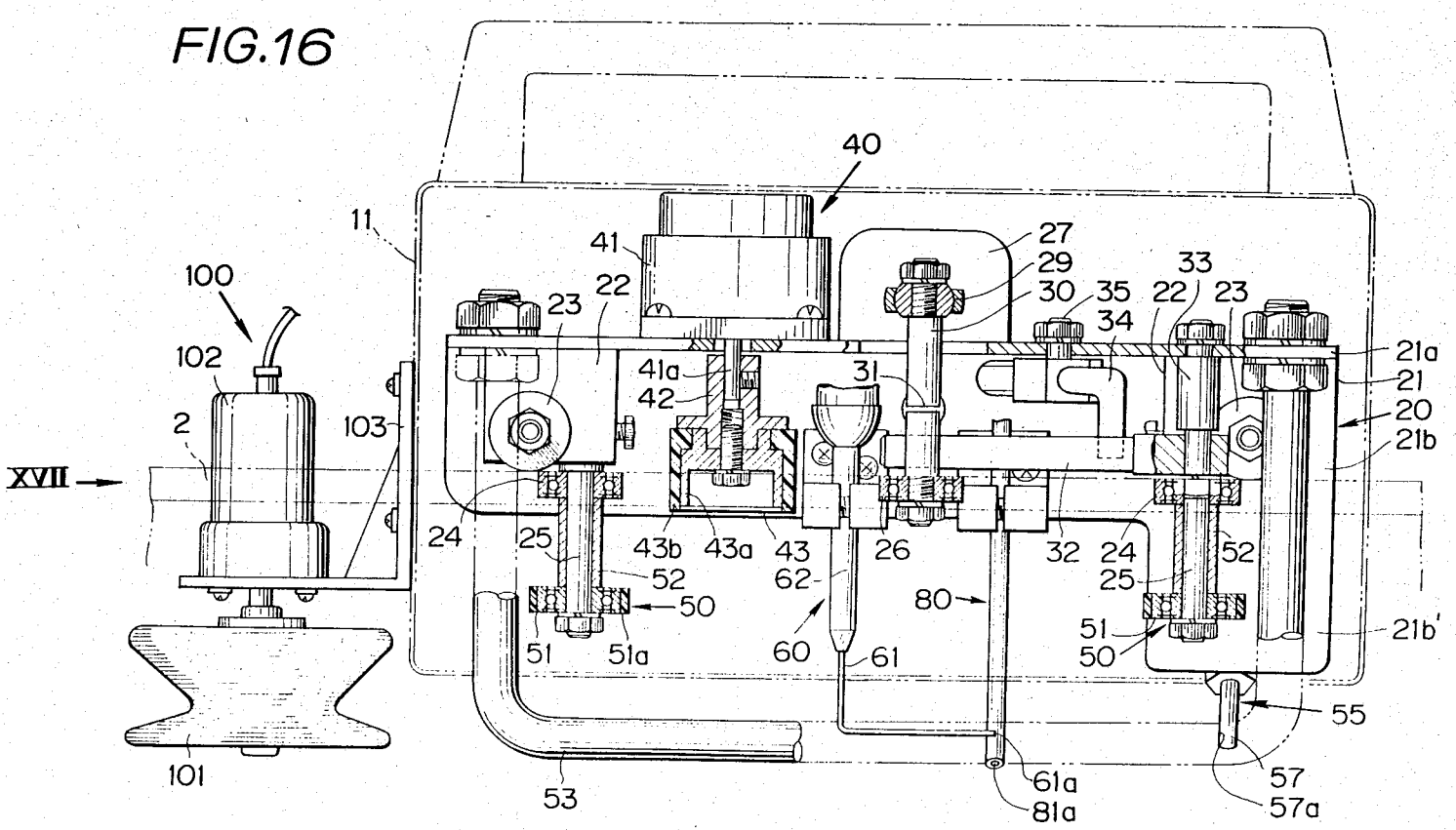
FIG. 16 is an elevational view, partly section, as viewed from an arrow XVI—XVI of FIG. 15.

As mainly shown in FIGS. 15 and 16, the device 10 includes the air ejection nozzle arrangement 55 which includes an air ejection 55 having an air ejection opening 57*a*. The air ejection nozzle 56 is securely supported by a base support member 56 to which an air tube 58 is connected so that the air ejection nozzle 57 is supplied with air through the air tube 58. In this instance, the side plate section 21*b* of the base plate 21 is extended downward and bent toward the reed 1 to form an extended section 21*b*'. The base support member 56 is securely installed on the extended section 21*b*' in such a manner that the tip end of the air ejection nozzle 57 is located in the vicinity of and forward the air guide channel 6, in which the extension of the axis of the air ejection opening 57*a* is directed into the air guide channel 6 diagonally toward the anti-weft picking side. Accordingly, an air stream due to the air ejection from the air ejection nozzle 57 is guided along the weft guide channel 6 toward the anti-weft picking side.

Figure 17:
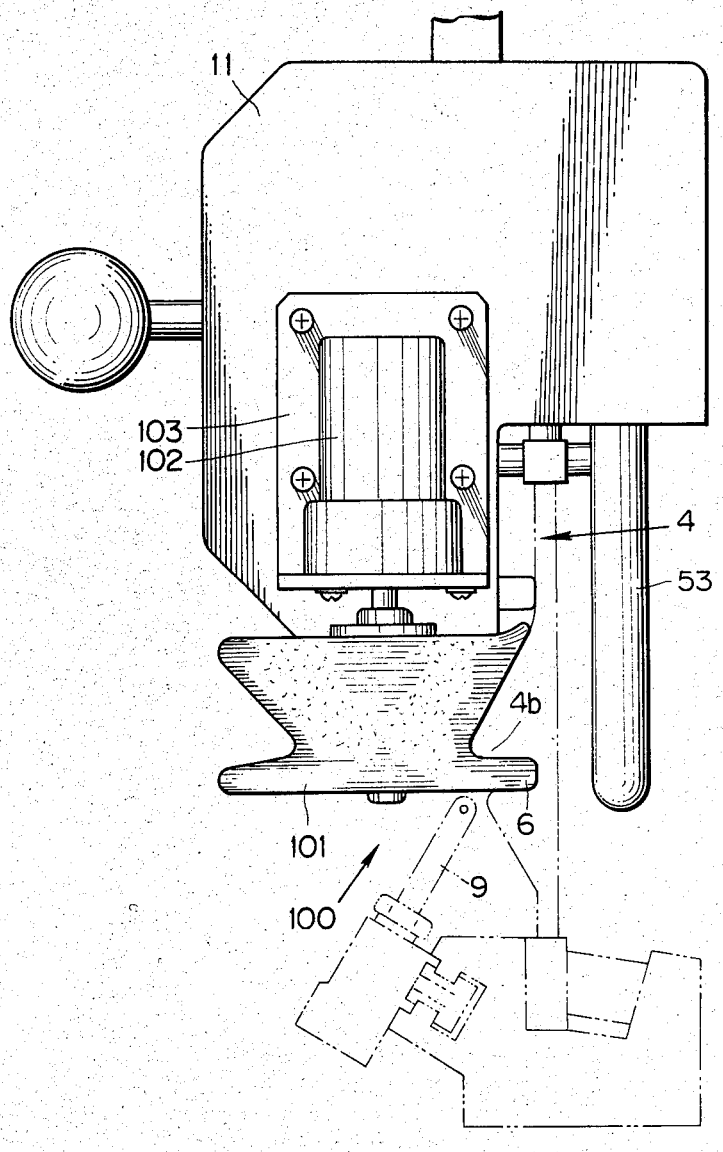
FIG. 17 is a side view taken in the direction of an arrow XVII—XVII of FIG. 16.

As shown in FIGS. 16 and 17, the cleaning means 100 of the device of this embodiment includes a rotatable brush 101 as a cleaning member. The rotatable brush 101 is connected to an electric motor 102 for driving the rotatable brush 101. The motor 102 is installed through a L-shaped bracket 103 to an end face of the cover 11 on the anti-weft picking side. The rotatable brush 101 is formed generally into the shape of a grooved wheel, in which the lower annular section is insertable into the air guide channel 6 while an upper frusto-conical section is engageable with the upper-half of the triangular section 4*b* shown in FIG. 14 wherein the triangular section 4*b* is integral with a main body section 4*a* of the reed blade 4, and the triangular section 4*b* is formed at its peak top portion with the groove 4*c* having a bottom portion 4*d* serving as a beating-up face which will strike against a cloth fell during bearing-up operation. Thus, the rotatable brush 101 of this shape can make cleaning not only for the air guide channel 6 but also for the triangular section upper-half which is contaminated by the ejected air streams generated by the auxiliary nozzles 9 and directed diagonally and upwardly to the anti-weft picking side. It will be understood that the cleaning means 100 in this embodiment may be replaced with one of the type wherein air is ejected to remove contaminants attached to the reed blades 4.

In this embodiment, the weight 53 serving as the handle adjusts the position of the center of gravity of the carrier 20 upon being balanced in weight with the air ejection nozzle 55, the flow velocity detector 70, the cleaning means 80 and the like, and hoses and cables connected thereto, thus preventing an excessive bending load from being applied to the reed blades 4 from the side of the support rollers 51.

With this arrangement, in case the auxiliary nozzles 9 are not operated to stop their air ejection, when the geared motor 41 is operated to drive the drive roller 43 upon air ejection nozzle 57 ejecting air, the carrier 20 runs along the air guide channel 6 in a desired direction in which the flow velocity detector 60 moves with the carrier 20 detecting the flow velocity of the air stream generated by the air jet from the air ejection nozzle 57 and flowing through the air guide channel 6. Simultaneously, the location detector 80 is also moved with the carrier 20, detecting the existence of the auxiliary nozzle 9 depending upon the light receiving amount variation at every time when the light casting and receiving section 81*a* of the optical-fiber cable 81 passes by the auxiliary nozzle 9. On the contrary, in case the auxiliary nozzles 9 are operated to eject air, the same operation is carried out upon stopping the operation of the air ejection nozzle 57.

Figure 18:
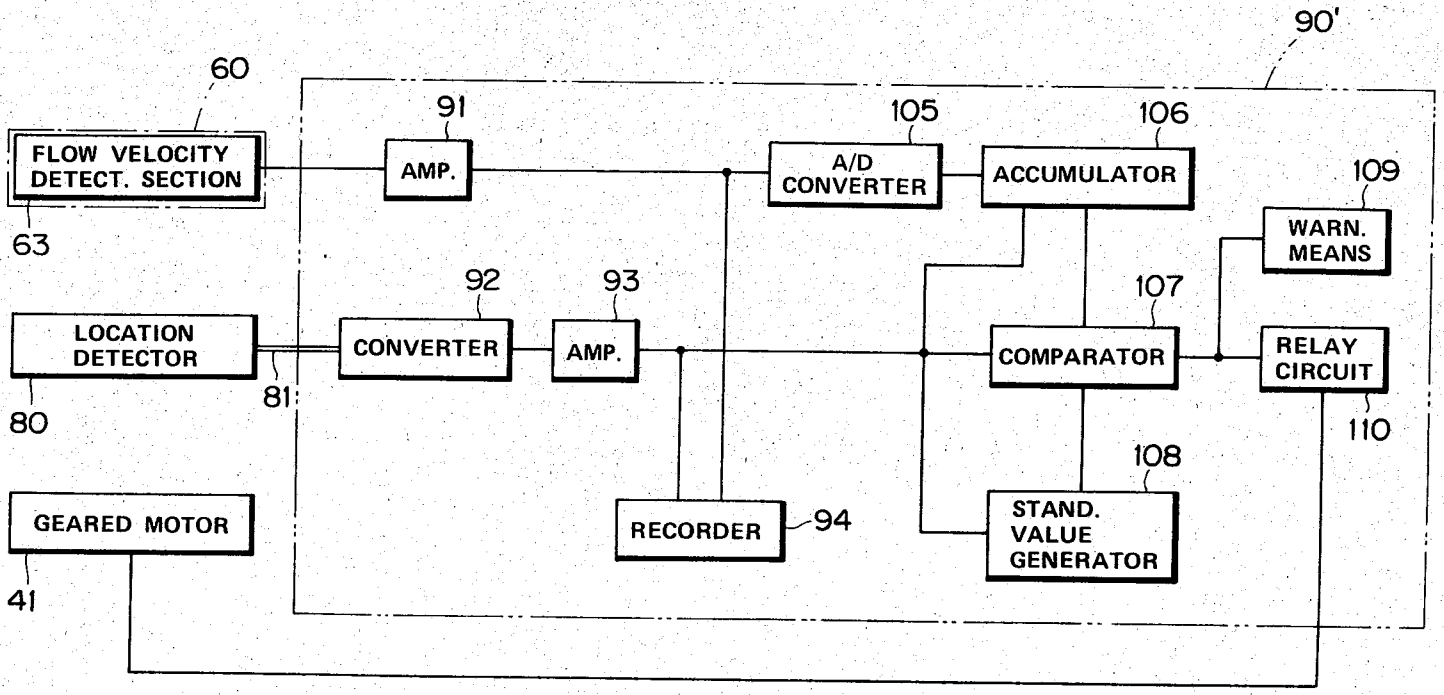
FIG. 18 is a block diagram of a recording and recognizing device for recording the data obtained by a flow velocity distribution detecting device of FIG. 14 and recognizing the result of the data.

FIG. 18 shows an example of a recording and recognizing device 90' forming part of the system, used in combination with the device 10 of FIGS. 14 to 17 for recording the detected result and for signalling to an inspection operator the fact that the location in a bad condition is detected. The recording and recognizing device 90' includes the first amplifier 91, the converter 92, the second amplifier 93 and the recorder 94 and arranged in the same manner as in the device 90 of the FIG. 12.

Figure 19:
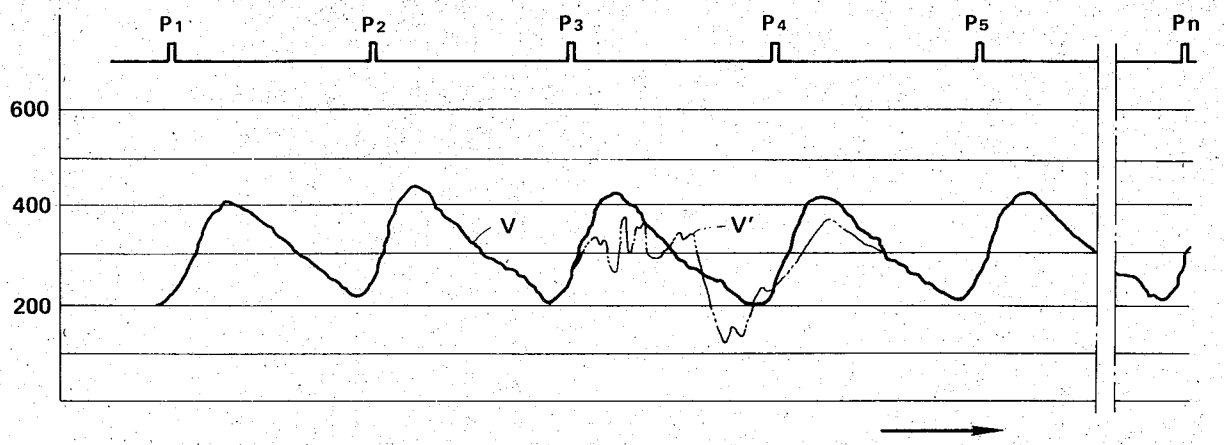
FIG. 19 is a graph of an example of the recorded data obtained by the device of FIG. 18.
Figure 14:
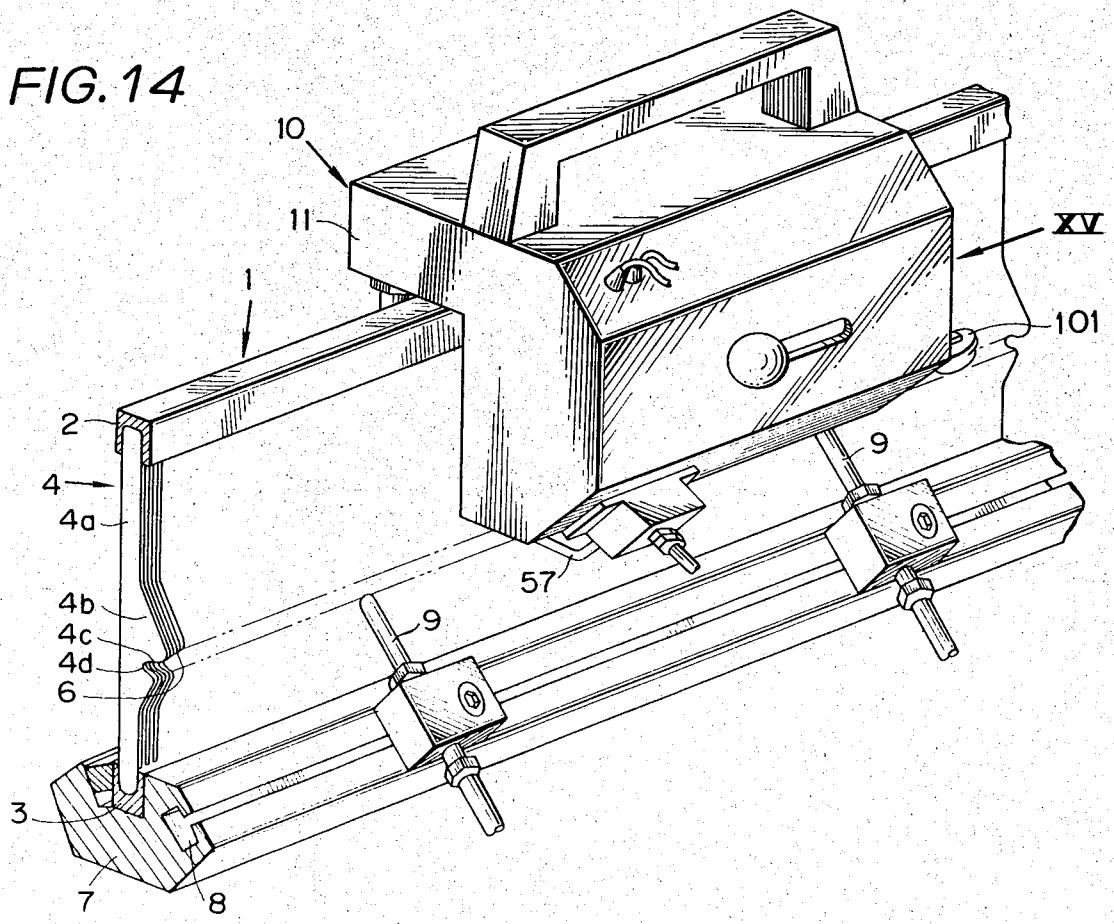
FIG. 14 is a perspective view similar to FIG. 1 but showing a fourth embodiment of the system according to the present invention.

FIG. 19 shows an example of a data recorded by the recorder 94 of FIG. 18 in which the graph of the data is similar to FIG. 13 except for the abnormal curve V' indicating an abnormality or bad condition in the row of the reed blades 4. The data was obtained by carrying out the detection operation of the device 11 in a condition where the auxiliary nozzles 9 were operated to eject air while stopping the operation of the air ejection nozzle 57.

A manner of operation of the system for detecting the location of a bad condition will be exemplified with reference to the graph of FIG. 19. First, the flow velocity curve V is detected on the reed 1 which has been well serviced to be recorded and stored as a normal curve. Thereafter, the flow velocity curve V is detected at suitable timings during operation of the loom. In case the abnormal curve V' as indicated in a dot-dash line appears within a range between the location markings $P_3$ and $P_5$, it is recognized that there arises the abnormality or the bad condition within this range. Accordingly, an inspection is made mainly to the range, and then a treatment such as cleaning is carried out; or the same detection operation is again made, operating the cleaning means 80 thereby to take a new data of the flow velocity curve V. In the latter case, if the abnormal curve V' becomes resembled to the normal curve V, it is judged that the abnormality is caused by the contamination of the reed 1 and consequently a further careful cleaning is made. Otherwise, if the abnormal curve V' has been still appeared in the graph of the data after the detection operation again made, it is judged that the abnormality is caused by the deformation of the reed blades 4 and consequently reparing or replacement of the reed blades 4 is made.

Turning to FIG. 18, the recording and recognizing device 90' further includes an analog-to-digital converter 105 electrically connected to the amplifier 91 to convert analog signals to digital signals. A accumulator 106 is electrically connected to the analog-to-digital converter 105 to accumulate the output from the converter 105. For example, the accumulator 106 includes a flip-flop circuit and an integrating circuit and adapted to accumulate the outputs corresponding to a region over, for example, a water head of 300 mmAq in FIG. 19 in every range of $P_1$ to $P_2$, $P_2$ to $P_3$, and the like, and the thus obtained accumulated values are input to a comparator 107 electrically connected to the accumulator 106. A standard value generator 108 is electrically connected to the comparator 107 and adapted to memorize an accumulated value of the outputs corresponding to the above-mentioned region, and the accumulated value is output to the comparator 107 at every termination of the above-mentioned ranges. In this connection, the comparator 107 compares the output value from the accumulator 97 with the output value from the standard value generator 108, and produces an abnormality signal when the difference between the two output values exceeds a predetermined level.

A warning means 109 is electrically connected to the comparator 107 and adapted to produce a warning signal upon receiving the abnormality signal from the comparator 107. The warning means includes a warning lamp adapted to be lighted upon receiving the abnormality signal, or a buzzer adapted to generate sound upon receiving the abnormality signal. An inspection operator makes a marking for the range at which the wanring means 109 is operated to produce the warning signal, for example, on the reed frame. Additionally, a relay circuit 110 electrically connected to the comparator 107 is of the normally closed type and adapted to be opened to cut off electrical connection of the geared motor 41 and an electric source (not shown) upon receiving the abnormality signal from the comparator 107, thereby to stop the carrier 20. As a result, it is recognized that there is an abnormality or bad condition at the location where the carrier 20 stops. It will be understood that such recognition of the location of a bad condition under the action of warning means and the relay circuit as carrier stopping means is simple and convenient for use in a factory. Furthermore, in case of accomplishing such recognition, a suitable treatment can be made upon using the cleaning means 80 in addition to the warning means and the relay circuit.

What is claimed is:

1. A system in combination with an air jet loom including means for defining a plurality of grooves on front side of a reed, said grooves being aligned in direction of weft picking to form an air guide channel, and auxiliary nozzles for ejecting air into said air guide channel, said system comprising:

a rail disposed parallel with said reed and extending in the weft picking direction;

a carrier engageable with said rail and movable along said rail;

means for maintaining said carrier in a predetermined posture; and a flow velocity detector for detecting the flow velocity of air flowing through said air guide channel, carried by said carrier and including a flow velocity sensing section located in said air guide channel.

2. A system as claimed in claim 1, wherein said system is for detecting distribution of flow velocity of air flowing through said air guide channel.

3. A system as claimed in claim 1, further comprising means for driving said carrier along the rail.

4. A system as claimed in claim 1, wherein said rail is disposed stationary relative to said reed.

5. A system as claimed in claim 1, wherein said carrier including a base member, and running wheels rotatably supported to said base member and engageable with said rail.

6. A system as claimed in claim 5, wherein said maintaining means includes support rollers rotatably supported to said carrier base member and engageable with a section of said loom which section extends parallel with said rail.

7. A system as claimed in claim 6, wherein said flow velocity detector is securely supported to said carrier base member.

8. A system as claimed in claim 7, wherein said rail has an elongate upper face, and first and second side faces integral with and perpendicular to said upper face, said faces extending along the weft picking direction.

9. A system as claimed in claim 8, wherein said rail forms part of an upper frame of said reed.

10. A system as claimed in claim 8, wherein said running wheels are engaged with said rail upper face, in which said carrier includes side rollers rotatably supported to said carrier base member, said side rollers being engageable with rail first side face, a press roller rotatably supported to said carrier base member and engageable with said rail second side face, and means for putting said press roller into a first position at which said press roller engages with said rail second side face and a second position at which said press roller is separate from said rail second side face in a condition where said running wheels and said side rollers are in engagement with said rail.

11. A system as claimed in claim 10, wherein said maintaining means includes support rollers rotatably supported to said carrier base member and engageable on said reed.

12. A system as claimed in claim 11, wherein each side roller is rotatably mounted on a shaft securely connected to said carrier base member, in which each support roller is rotatably mounted on said shaft.

13. A system as claimed in claim 11, wherein said maintaining means includes a weight securely supported to said carrier base member and located on opposite side of said support rollers relative to said reed.

14. A system as claimed in claim 11, wherein said flow velocity detector includes a pitot tube whose tip end section is insertable into said air guide channel.

15. A system as claimed in claim 14, further comprising means for driving said carrier along said rail, in which said driving means includes an electric motor secured to said carrier base member, and a driven roller connected to said electric motor to be driven, said driven roller being engageable with said rail.

16. A system as claimed in claim 14, wherein said flow velocity detector includes a plurality of pitot tubes each having an open tip end, the open tip ends of pitot tubes being located in said air guide channel and arranged approximately in a plane corresponding to a cross-section of said air guide channel.

17. A system as claimed in claim 10, further comprising a location detector for detecting location of said auxiliary nozzles during movement of said carrier, in which said location detector includes an optical-fiber cable securely supported to said carrier base member, said optical-fiber cable respectively having a tip end through which light is casted and received, said tip end being located to be able to face said auxiliary nozzles.

18. A system as claimed in claim 10, wherein said system is for detecting a location in a bad condition in a row of reed blades of said reed, in which said system further comprising an air ejection nozzle which ejects air into said air guide channel to form an air stream flowing through said air guide channel and cleaning means for cleaning at least said air guide channel during movement of said carrier, said cleaning means being incorporated with said carrier.

19. A system as claimed in claim 18, wherein said air ejection nozzle is securely supported to said carrier base member and having an air ejection opening located to eject air into said air guide channel in such a manner as to generate an air stream toward an anti-weft picking side in said air guide channel.

20. A system as claimed in claim 19, wherein said cleaning means includes an electric motor securely connected to said carrier base member, and an rotatable brush connected to said electric motor to be driven, said brush having at least an annular section insertable into said air guide channel.

21. A system as claimed in claim 1, further comprising a location detector for detecting location of said auxiliary nozzles during movement of said carrier.

22. A system as claimed in claim 21, further comprising means recording the flow velocity detected by said flow velocity detector and the auxiliary nozzle location detected by said location detector as a data.

23. A system as claimed in claim 21, wherein said system is for detecting a location in a bad condition in a row of reed blades of said reed.

24. A system as claimed in claim 23, further comprising an air ejection nozzle which ejects air into said air guide channel to form an air stream flowing through said air guide channel.

25. A system as claimed in claim 24, further comprising cleaning means for cleaning at least said air guide channel during movement of said carrier, said cleaning means being incorporated with said carrier.

26. A system as claimed in claim 23, further comprising means for recording the flow velocity detected by said flow velocity detector and the auxiliary nozzle location detected by said location detector as a data.

27. A system as claimed in claim 26, further comprising means for generating a warning signal when said flow velocity detector detects a flow velocity representative of said bad condition.

28. A system as claimed in claim 27, further comprising means for driving said carrier along the rail, in which said system further includes means for stopping said driving means when said flow velocity detector detects a flow velocity representative of said bad condition.

29. A system as claimed in claim 28, further comprising means for operatively connecting said warning signal generating means and said stopping means with said recording means to be operative in timed relation to each other.

* * * * *